US005522330A

United States Patent [19]

Nishi et al.

[11] Patent Number: 5,522,330

[45] Date of Patent: Jun. 4, 1996

[54] DRIVE DEVICE FOR A SEWING MACHINE

[75] Inventors: Nobuhiro Nishi; Toshiaki Sunada; Tadashi Kato; Takashi Nishikawa; Yoshikatsu Hattori, all of Tokyo, Japan

[73] Assignee: Juki Corporation, Tokyo, Japan

[21] Appl. No.: 363,910

[22] Filed: Dec. 27, 1994

[30] Foreign Application Priority Data

Dec. 28, 1993 [JP] Japan ..... 5-355280
Dec. 28, 1993 [JP] Japan ..... 5-355283

[51] Int. Cl.[6] ..... D05B 69/18

[52] U.S. Cl. ..... 112/275

[58] Field of Search ..... 112/220, 221, 112/275, 277, 67

[56] References Cited

U.S. PATENT DOCUMENTS

| | | | |
|---|---|---|---|
| 3,757,232 | 9/1973 | Matsuda | 112/275 |
| 3,967,566 | 7/1976 | Spiegel et al. | 112/275 |
| 4,501,210 | 2/1985 | Hanyu et al. | 112/220 X |

FOREIGN PATENT DOCUMENTS

| | | | |
|---|---|---|---|
| 2922544 | 12/1979 | Germany | 112/220 |
| 1156851 | 7/1969 | United Kingdom . | |
| 1271266 | 4/1972 | United Kingdom . | |
| 1282153 | 7/1972 | United Kingdom . | |
| 2021163 | 11/1979 | United Kingdom . | |
| 1560868 | 2/1980 | United Kingdom . | |
| 1114614 | 8/1983 | United Kingdom . | |
| 2184568 | 6/1987 | United Kingdom . | |

*Primary Examiner*—Peter Nerbun
*Attorney, Agent, or Firm*—Finnegan, Henderson, Farabow, Garrett & Dunner

[57] ABSTRACT

A drive device for a sewing machine which varies the speed of the auxiliary motor. In a sewing machine drive device, the rotation of a clutch motor is transmitted through a pulley and an endless belt to the spindle of the sewing machine. The rotation of an auxiliary motor is transmitted through a driving sprocket, a timing belt and a driven sprocket and through the pulley to the spindle of the sewing machine. The drive device includes rotation varying means which varies the rotation of the auxiliary motor in response to the variation in diameter of the driving pulley of the clutch motor.

5 Claims, 14 Drawing Sheets

DRIVE DEVICE FOR A SEWING MACHINE

BACKGROUND OF THE INVENTION

1. Field of the Invention

This invention relates to a drive device for a sewing machine, and, more particularly, to an improvement of a drive device that rotates a spindle on the sewing machine at a high speed by a clutch motor and at a low speed by an auxiliary motor.

2. Description of the Related Art

A sewing machine drive device of this type has been disclosed by Japanese Unexamined Utility Model Publication (OPI) No. Sho. 53-17468 (the term "OPI" as used herein means an "unexamined application"). In the drive device, the auxiliary motor is coupled to the spindle of the sewing machine. A foot pedal is directly connected by a rod to an operative lever which corresponds to a clutch lever for a clutch motor.

In the conventional sewing machine drive device, an auxiliary motor is coupled to a spindle of the sewing machine. However, coupling the auxiliary motor directly to the spindle of the sewing machine does not allow for proper rotation speed control. In order to overcome this difficulty, it is preferable to couple the auxiliary motor to a clutch motor.

In addition, the conventional drive device responds slowly to switching from a driving position to a stop position. The operating lever (that is, the clutch lever) is connected directly to the foot pedal, and the operation of the operating lever is caused directly by stepping on the foot pedal which results in a slower switching time.

Furthermore, even if the operating lever of the conventional drive device has a spring which pushes the operating lever toward the stop position, it is difficult for this feature alone to improve the switching character,

SUMMARY OF THE INVENTION

An object of the invention is to provide a drive device for a sewing machine of the type in which the drive shaft of the auxiliary motor is coupled to the drive shaft of the clutch motor, and in which the rotation of the auxiliary motor is changed with the variation in diameter of a pulley or the like mounted on the drive shaft of the clutch motor.

A further object, is to provide a drive device for a sewing machine which improves the switching time between the driving position and the stop position.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects in accordance with the purpose of the invention, as embodied and described herein, the drive device for use with a sewing machine, of this invention comprises a drive shaft of a clutch motor for rotating a shaft on the sewing machine at a first speed, the drive shaft of a clutch motor is operatively coupled to a drive shaft of an auxiliary motor for rotating the shaft on the sewing machine at a second speed, where the second speed is less than the first speed, and rotation varying means for varying a rotation speed output from the auxiliary motor.

In a second embodiment the drive device for use with a sewing machine comprises a clutch motor with a clutch lever having a driving position, a neutral position and a stop position, the clutch motor rotating a shaft on the sewing machine at a first speed, an auxiliary motor rotating the shaft of the sewing machine at a second speed less than the first speed, and control means for selectively transmitting the rotation speed from one of the clutch motor and the auxiliary motor to the shaft of the sewing machine. The control means includes an actuator having a neutral step position, plural front step position and plural rear step position, and transmitting means for transmitting a position of the actuator to the clutch lever, the transmitting means having a first operating lever connected with the actuator, a second operating lever connected with the first operating lever, the second operating lever moving a distance proportional to the first operating lever and an elastic member, the elastic member connecting the second operating lever with the first operating lever and forcing the clutch motor toward the stop position when the actuator is moved from the front step position to the rear step position.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DETAILED DESCRIPTION OF THE INVENTION

Preferred embodiments of the invention will be described with reference to the accompanying drawings.

Figure 1:
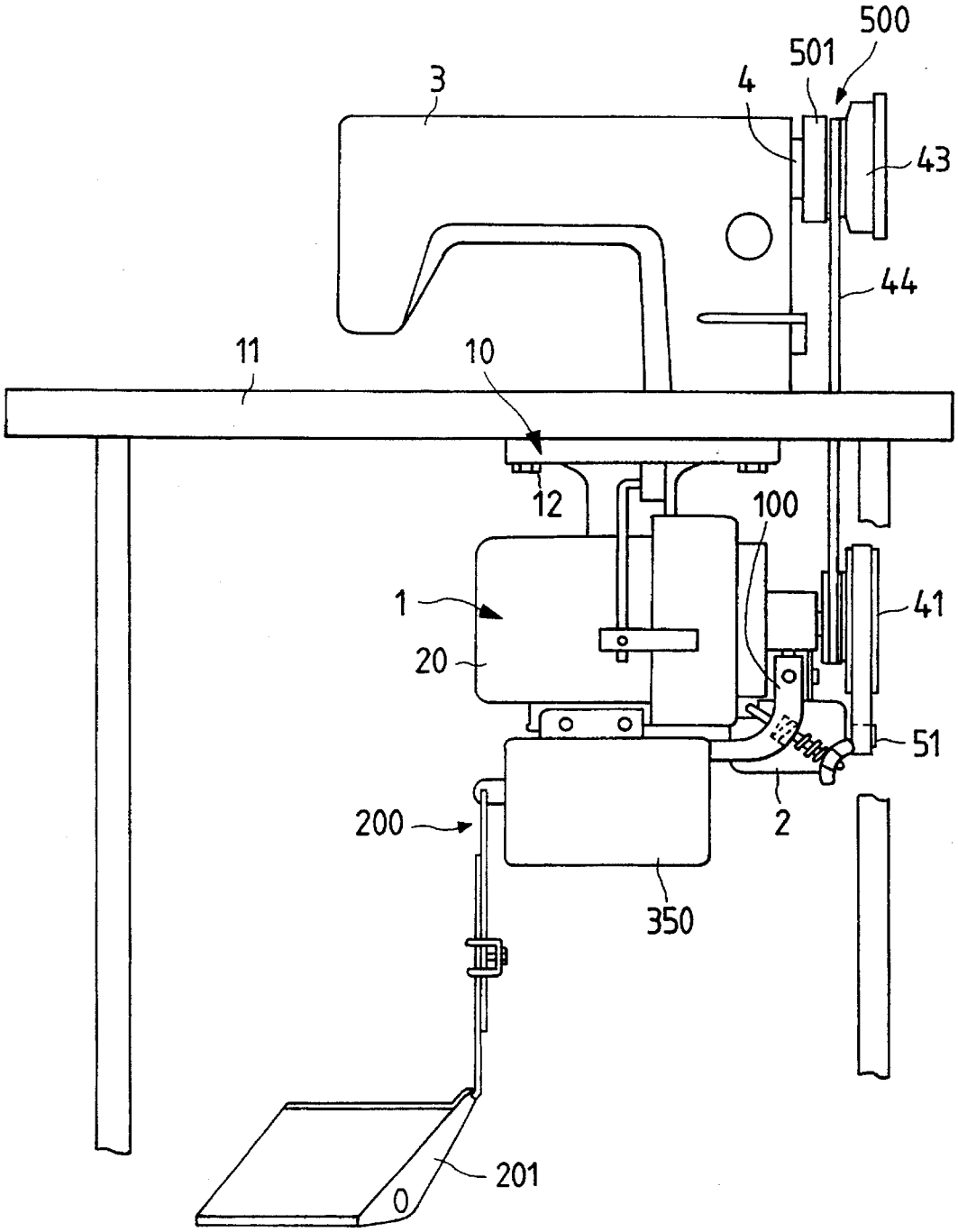
FIG. 1 is a perspective view of a sewing machine equipped with an example of a sewing machine drive device which constitutes a first embodiment of the invention.
Figure 2:
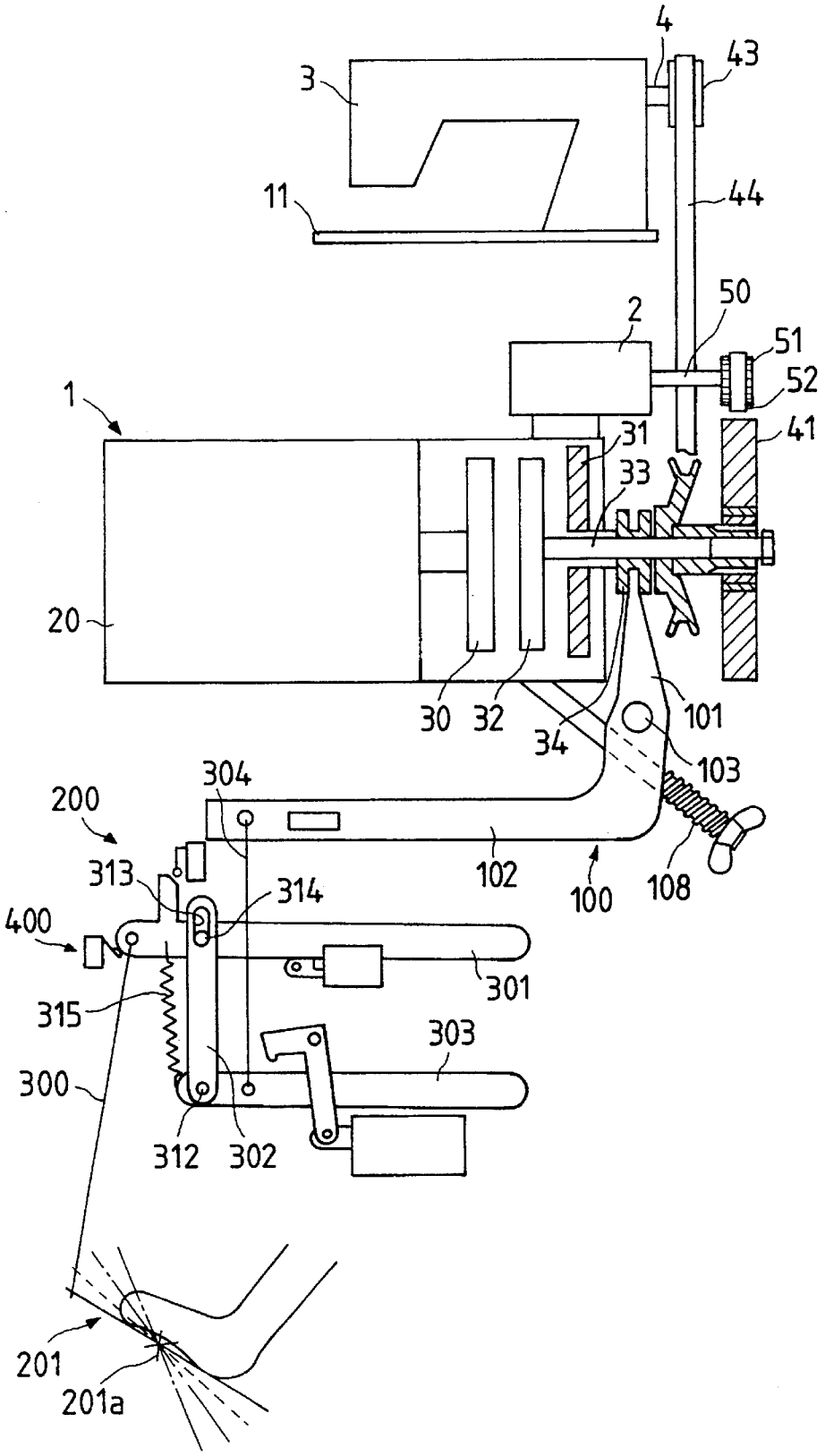
FIG. 2 is an explanatory diagram, partly as a sectional diagram, showing the sewing machine drive device of the invention.

FIGS. 1 and 2 show a drive device for a sewing machine, which constitutes a first embodiment of the invention. The drive device, as shown in FIGS. 1 and 2, has a clutch motor 1 and an auxiliary motor 2. The clutch motor 1 rotates the spindle 4 of the sewing machine 3 at a high speed to perform an ordinary sewing operation. The auxiliary motor 2 rotates the spindle 4 of the sewing machine at low speed, for instance, to stop the sewing needle at a desired position.

The clutch motor 1 is mounted on frame means 10 which is fixedly secured to the lower surface of a sewing machine table 11 with known means such as bolts 12.

Figure 6A:
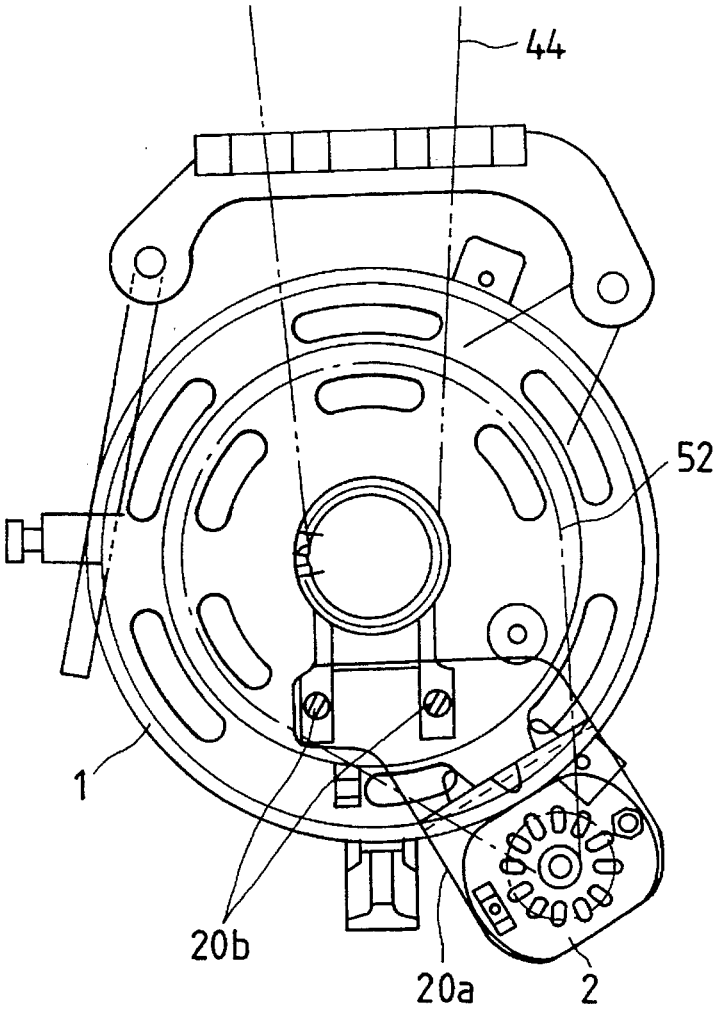
FIG. 6A is a front view showing the connection of the clutch motor and the auxiliary motor.

The auxiliary motor 2 is separate from the sewing machine 3 and the spindle 4. In the embodiment, the auxiliary motor 2 is mounted on the casing 20 of the clutch motor 1. More specifically, as shown in FIG. 6*a*, a mounting board 20*a* is mounted on the casing 20 of the clutch motor, and is fixedly secured to the casing 20 with screws 20*b* which are engaged with threaded holes formed in a pulley cover. In order to set the clutch motor 1 and the auxiliary motor 2 at desired positions, the casing s of the clutch motor 1 and the auxiliary motor 2 have mounting bolt holes and flanges, which are formed when manufactured. By using the bolt holes and flanges, the auxiliary motor 2 is fixed to the clutch motor 1. This method is advantageous in that the auxiliary motor 2 can be secured to the clutch motor 1 without modification of the motors, i.e., by using the holes and flanges of the casings.

Figure 5:
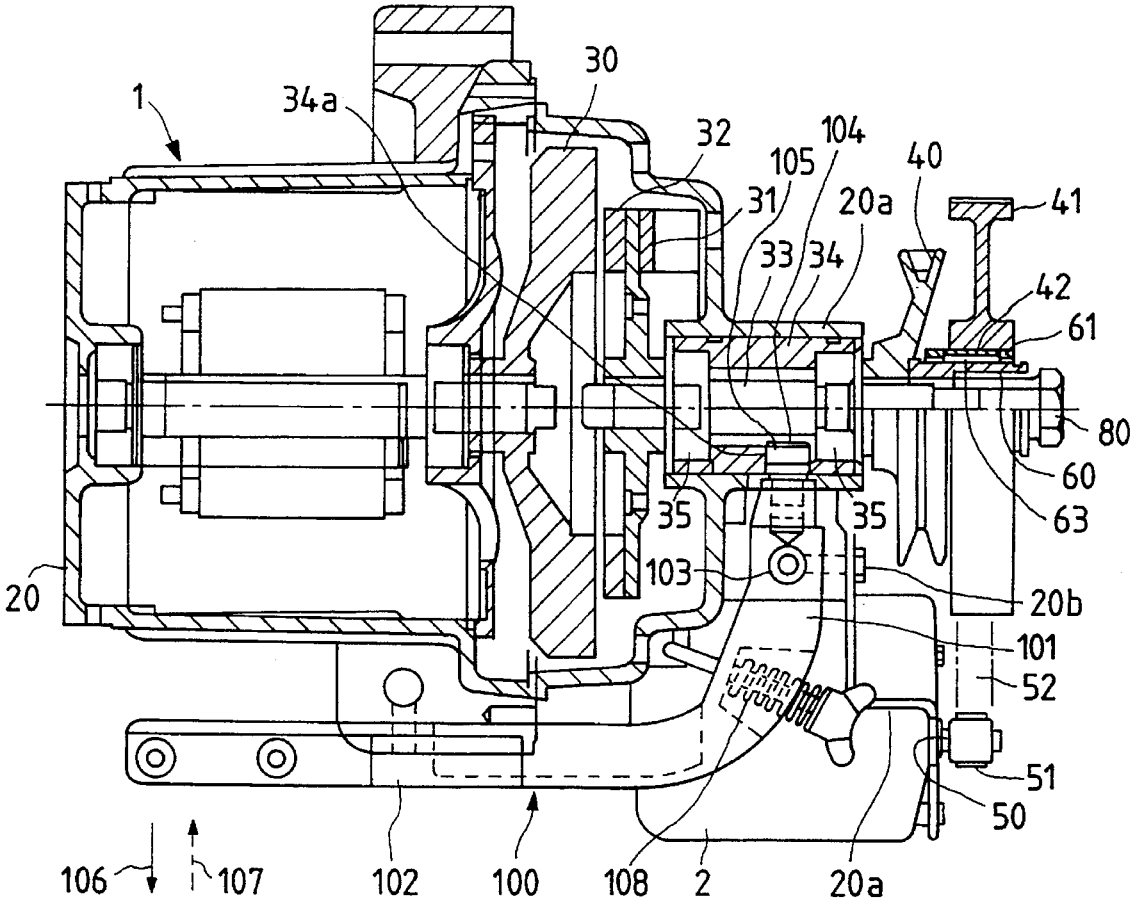
FIG. 5 is a side view, partly as a sectional diagram, showing a clutch motor and an auxiliary motor.

The clutch motor 1, as shown in FIG. 2, comprises a rotor 30 which is the driving element of the motor 1; a brake shoe 31 fixed in the casing 20 of the motor 1; and a clutch board 32 arranged between the rotor 30 and the brake shoe 31 in such a manner that it may be moved to provide contact with either the brake shoe 31 or the rotor 30. The clutch motor 1 has a drive position where the clutch board 31 is in contact with the rotor 30, a stop position where the clutch board 31 is in contact with the brake shoe 31, and a neutral position where the clutch board 32 is not in contact with the rotor 30 or the brake shoe 31. The clutch board 32 is mounted on one end portion of a clutch shaft 33 which serves as the drive shaft of the clutch motor. The middle portion of the clutch shaft 33 is supported by suitable bearing s 35 and 35' so that the clutch shaft is rotatable with respect to a carrier 34 but not movable axially. The carrier 34, as shown in FIG. 5, is horizontal, (as viewed in FIG. 5) slidable, and supported by the bearing s 35 and 35' fitted in the casing 20 of the clutch motor 1 so that the clutch shaft 33 is allowed to move axially to take the above-described three positions; i.e., the drive position, the neutral position, and the stop position, The other end portion of the clutch shaft 33 is extended through the carrier 34. A driving pulley 40 is mounted on the other end portion of the clutch shaft 33 in such a manner that it is located next to the carrier 34. Furthermore, a driven sprocket 41 is mounted through a one-way clutch 42 on the clutch shaft 33 in such a manner that it is located adjacent to the driving pulley 40.

An endless belt 44 is trained about the driving pulley 40 and a driven pulley 43 fixedly mounted on the spindle 4 of the sewing machine. The driving pulley 40 and the driven pulley 43 are v-pulleys, and the endless belt 44 is a V-belt.

In the preferred embodiment, the driven sprocket 41 is coupled through a timing belt 52 to a driving sprocket 51 fixedly mounted on the drive shaft 50 of the auxiliary motor 2. The driven sprocket 41 is larger in effective diameter than the driving sprocket 51. This is advantageous in that the drive torque of the clutch shaft of the auxiliary motor can be increased, which contributes to an improvement of the running cost.

When the clutch motor 1 is in the drive position, the clutch board 32 is in contact with the rotor 30, and the clutch shaft 33 is rotated such that the spindle 4 of the sewing machine is rotated through the driving pulley 40 and the endless belt 44.

The rotation of the auxiliary motor 2 is transmitted through the driving sprocket 51, the timing belt 52, the driven sprocket 41, and the one-way clutch 42 to rotate the clutch shaft 33. The rotation of the clutch shaft 33 is transmitted through the driving pulley 40, the endless belt 44, and the driven pulley 43 to rotate the sewing machine spindle 4. In this operation, transmission of the rotation of the clutch motor 1 to the driven sprocket 41 is prohibited by the one-way clutch 42.

Figure 6B:
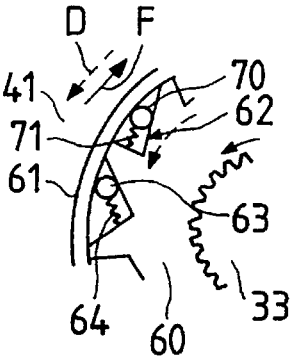
FIG. 6B is an enlarged diagram showing part of a one-way clutch.

As was described above, the one-way clutch 42 functions to prevent transmission of the rotation of the clutch motor 1 to the auxiliary motor 2. The one-way clutch 42 comprises a bushing 60 fitted on the clutch shaft 33, and an outer cylinder 61 rotatably fitted on the bushing 60. The driven sprocket 41 is fitted on the outer cylinder 61, and is secured to the latter 61 by suitable means. As shown in FIG. 6B, a plurality of triangular cuts 62 are formed in the outer periphery of the bushing 60 at equal angular intervals, thus defining triangular spaces, each including a relatively narrow space 70 and a relatively wide space 71 between the inner cylindrical surface of the outer cylinder and the outer cylindrical surface of the bushing 60. In each of the triangular spaces, a roller 63 is provided as shown FIG. 6B, and is pushed by a spring 64.

Figure 7:
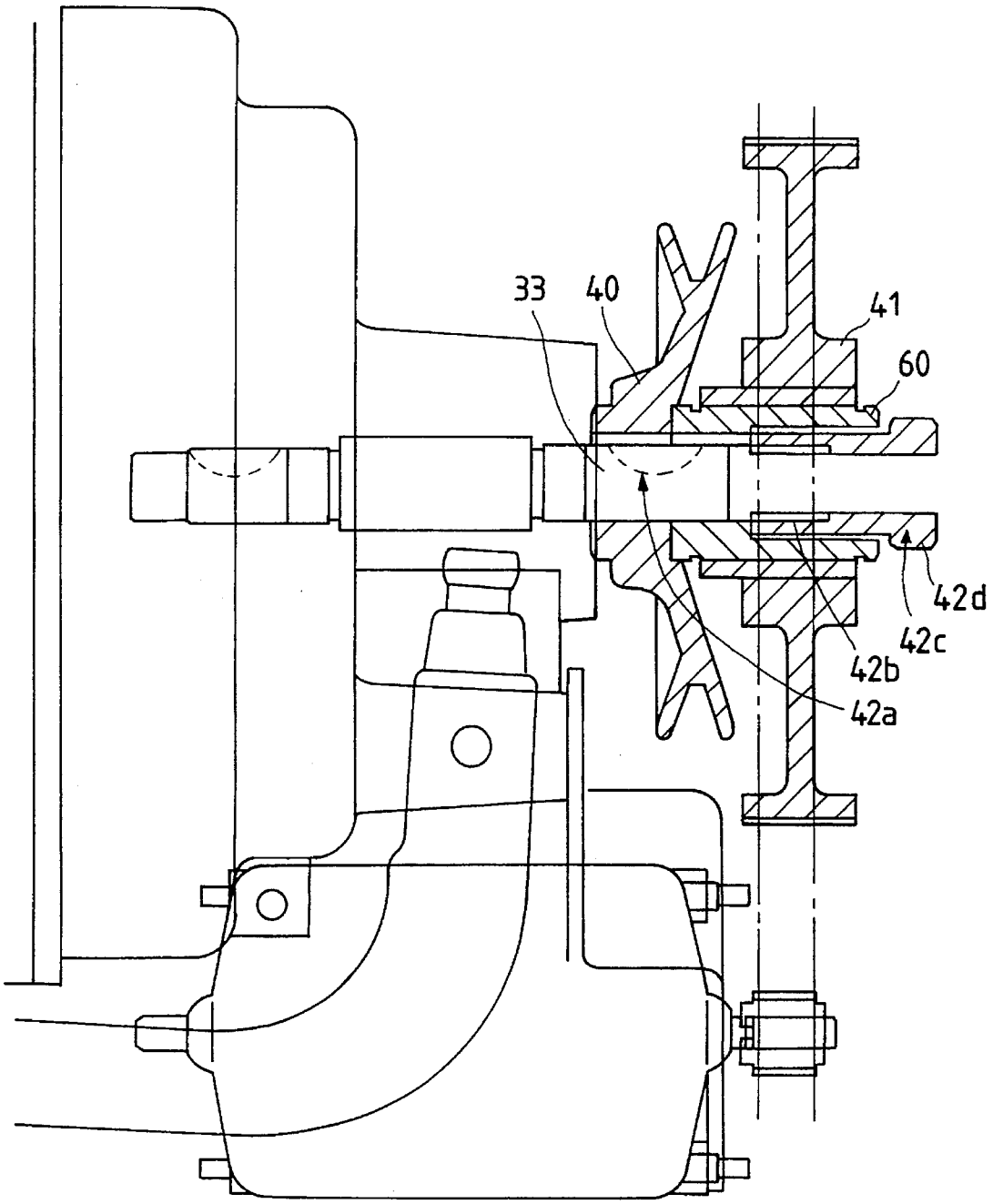
FIG. 7 is an enlarged sectional view of the one-way clutch.

The driving pulley 40, the one-way clutch 41, and the driven sprocket 41 can be mounted on the clutch 33 without modification of the clutch 33. Previously, only the driving pulley was fitted on the clutch shaft 33 with key means 42*a*, and it is fixedly secured to the clutch shaft 33 with a nut 42*c* and a screw 42*b* formed in the end face of the clutch shaft. On the other hand, in the invention as shown in FIG. 7, a recess in the driving pulley 40, key means, and a screw formed in the clutch shaft 33 with which a nut is connected, are utilized.

The driving pulley 40 has the recess in the outer surface. The bushing 60 is mounted and slid on the clutch shaft 33 while being engaged with the conventional key means on the clutch shaft 33 until it is fitted in the recess of the driving pulley. The nut is inserted into the bushing 60, and threadably engaged with the screw of the clutch shaft 33. The nut has a hexagonal head 42*d* to turn.

When the driven sprocket 41 is turned in the direction of the broken-line arrow D by the auxiliary motor 2, as shown in FIG. 6B, the outer cylinder 61 of the one-way clutch 42 is turned in the same direction, so that the rollers 63 are positioned in the relatively narrow spaces 70, whereby the bushing 60 is turned in the same direction as the outer cylinder 61. Thus, the clutch shaft 33, being coupled through the key to the bushing 60, is turned with the bushing 60. The rotation of the driven sprocket 42 in the direction of the arrow D rotates the clutch shaft 33 in the same direction (indicated by the broken line).

When the clutch shaft 33 is turned by the clutch motor 1 in the direction indicated by the broken line in FIG. 6B, the bushing 60 is rotated together with the clutch shaft 33, so that the rollers 63 are positioned in the relatively wide spaces 71 against the elastic forces of the spring s Hence, the rotation of the bushing is not transmitted to the outer cylinder 61 and the rotation of the clutch motor 1 is not transmitted to the driven sprocket 41.

When the auxiliary motor 2 rotates, the clutch motor 1 takes the neutral position. The clutch board 32 is free from the rotor 30 and the brake shoe 31 (described later in detail).

A clutch lever 100 is provided to move the clutch board 32 and the carrier 34, to allow the clutch motor to take the drive position, the neutral position, or the stop position.

The clutch lever 100 is substantially L-shaped, as shown in FIGS. 2 and 5, having a vertical portion 101 and a horizontal portion 102 extending from the vertical portion 101. As shown in FIG. 5, the middle of the vertical portion 101 is rotatably coupled through a shaft 103 to the casing 20 of the clutch motor 1. A coupling pin 104 is coupled to one end of the clutch lever 100, e.g., the end of the vertical lever. The coupling pin 104 has a head 105 which is smoothly fitted in a hole 34*a* formed in the carrier 34. At the other end of the clutch lever 100, the end of the horizontal portion 102 of the clutch lever 100, is moved in the direction of the solid-line arrow 106, the carrier 34 and the clutch shaft 33 are moved to the left as viewed in FIG. 5, so that the clutch board 32 is moved towards the rotor 30. When, in contrast, the end of the horizontal portion 102 is moved in the direction of the broken-line arrow 107, the carrier 34 and the clutch shaft 33 are moved to the right in FIG. 5, so that the clutch board 32 is moved towards the brake shoe 31. FIG. 5 shows the clutch board 32 engaged with the brake shoe 31.

In FIGS. 2 and 5, reference numeral 108 designates a clutch lever return spring which pushes the clutch lever 100 so that the clutch board 32 is in contact with the brake shoe 31 by the clutch lever 100. The clutch lever 100 is coupled to control means. The control means operates, for instance, to rotate the clutch motor 1 and the auxiliary motor to permit various sewing operations.

In a preferred embodiment, the control means comprises transmission means 200 connected to the clutch lever 100, and an actuator 201 coupled Lo the transmission means 200. In the embodiment, the actuator 201 is a pedal. Similarly as in the case of the pedal of an ordinary sewing machine, the middle portion of the pedal is rotatably supported through a shaft 201*a* on the legs of the sewing machine. The pedal may be swung by the foot of the operator to a plurality of front step positions, a neutral (release) position, and a plurality of rear step positions. The term "front step" as used herein is intended to mean that the foot depresses the front portion of the pedal which is located ahead of the shaft 201*a*. Similarly, the term "rear step" as used herein is intended to mean that the foot depresses the rear portion of the pedal which is located behind the shaft 201*a*. The pedal is operated as indicated by the broken lines in FIG. 2 or as indicated by the arrow in FIG. 3 in the front step and the rear step.

The transmission means 200 comprises a first operating lever 301 coupled through a first coupling rod 300 to the actuator, namely, the pedal 2017 a second operating lever 303 coupled through a coupling lever 302 to the first operating lever 301; and a second coupling rod 304 through which the second operating lever is coupled to the clutch lever 100. The transmission means 200 is provided on one side of a mounting board 305 which may be fixedly secured to the casing of the clutch motor 1.

Figure 3:
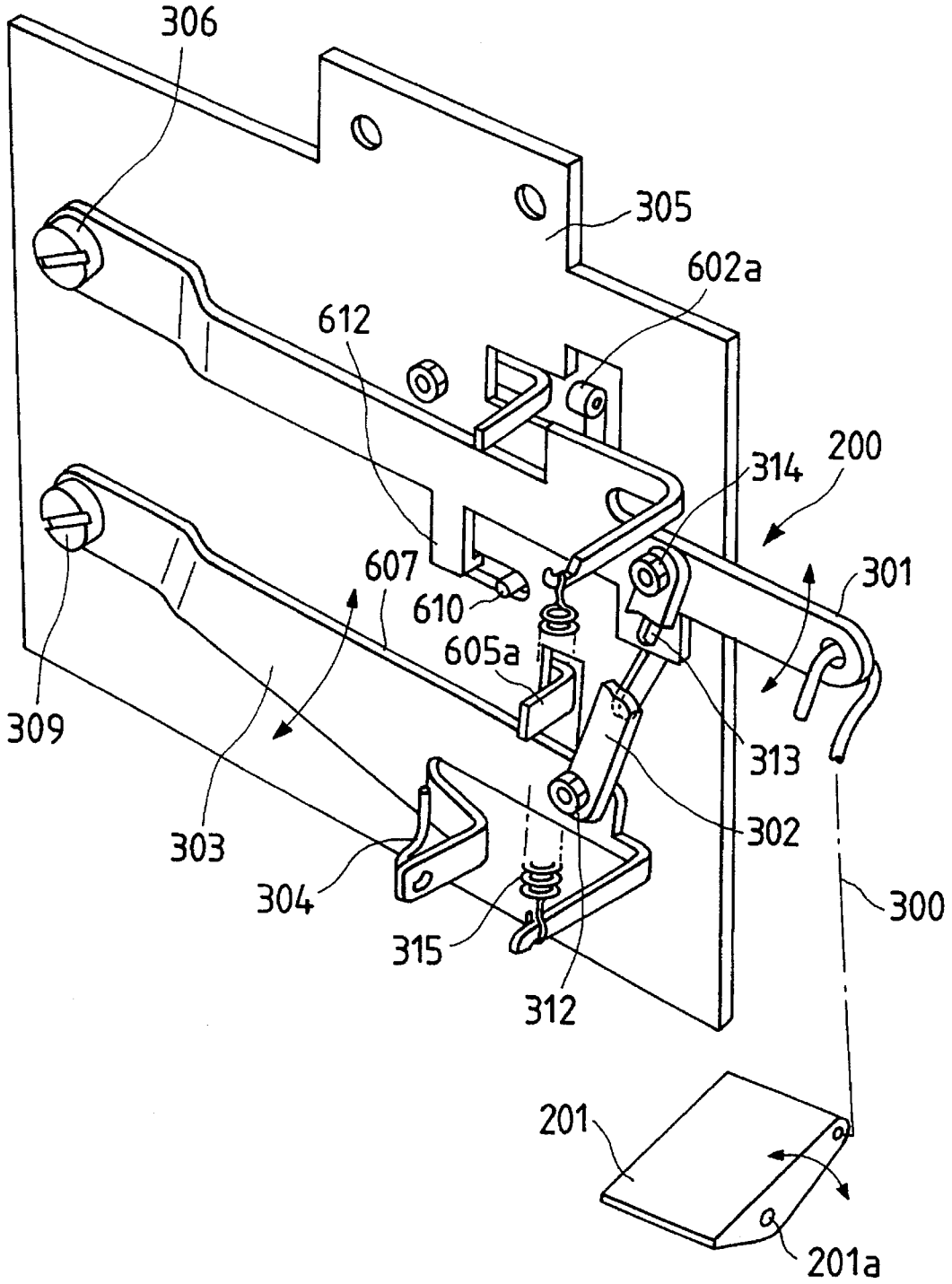
FIG. 3 is a perspective view showing one side of the transmission means in the sewing machine drive device of the invention.
Figure 4:
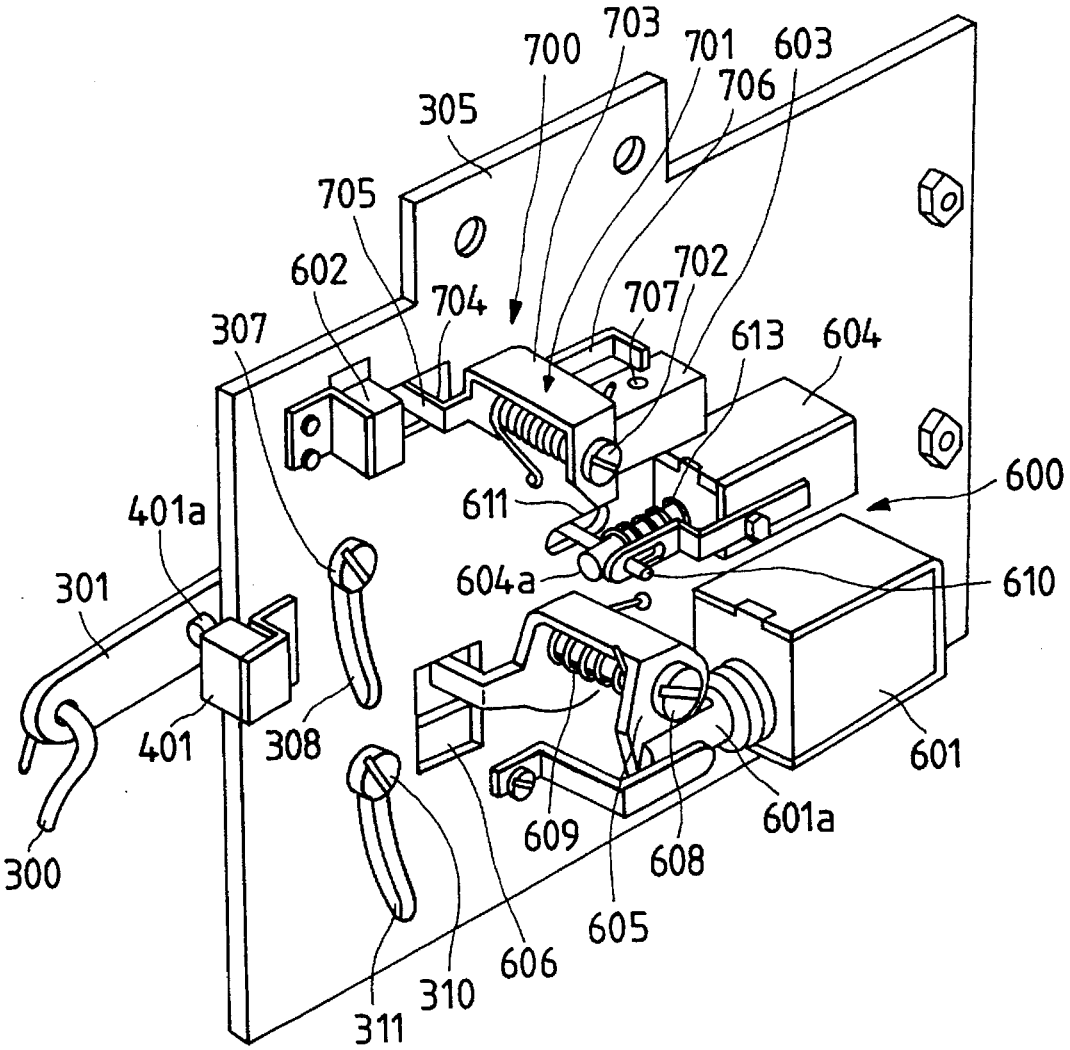
FIG. 4 is a perspective view showing the other side of the transmission means shown in FIG. 3.

As shown in FIG. 3, one end portion of the first operating lever 301 is rotatably supported on the mounting board 305 through a shaft 306, and the other end portion is coupled through the first coupling rod 300 to the pedal 201. A shaft 307 is secured to the middle of the first operating lever 301, near the other end of the operating lever 301. As shown in FIG. 4, the shaft 307, thus secured, is connected to an arcuate slot 308 formed in the mounting board 305. The second operating lever 303 is arranged substantially in parallel with the first operating lever 301, and its one end portion is rotatably supported on the mounting board 305 by a shaft 309. Similarly, as in the case of the first operating lever 303, a shaft 310 is secured to the middle of the second operating lever 303, near the other end of the second operating lever 303, and is connected to an arcuate slot 311 formed in the mounting board 305. As the pedal is swung in the directions of the arrow in FIG. 3, the first and second operating levers 301 and 303 are swung about the shafts 306 and 309 in the directions of the arrows, respectively. The first and second operating levers are coupled through a coupling mechanism so that they are movable a certain distance relative to each other. The coupling mechanism is designed as follows: one end portion of the coupling lever 302 is rotatably mounted on a shaft 312 formed on the second operating lever 303, and a slot 313 is formed in the other end portion of the coupling lever 302 in such a manner that the slot is elongated longitudinally from the coupling lever 302, and a pin 314 is secured to the first operating lever 301 is engaged through the formed elongated slot 313. As shown in FIGS. 2 and 3, the first operating lever 301 is coupled to the second operating lever 303 through an elastic member which is a tension spring 315 in the preferred embodiment. One end portion of the second coupling rod 304 is connected an end of the second operating lever 303. The other end portion of the second coupling rod 304 is connected to the horizontal portion 102 of the clutch lever 100.

When, with the pin 314 at the lower end of the slot 313 of the coupling lever 302, the front step is carried out to move the first coupling rod 300 downwardly, the first operating lever 301 is swung downwardly as viewed in FIGS. 2 and 3 while the coupling lever 302 is moved downwardly as viewed in FIG. 2 and the second operating lever 303 is swung downwardly. As the second operating lever 303 is swung in this manner, the second coupling rod 304 is moved downwardly, so that the horizontal portion 102 is moved in the direction of the solid line arrow. As a result, the clutch board 32 is moved from its position shown in FIG. 5 towards the rotor 30, thereby moving from the stop position to the neutral position. As shown in FIG. 1, a cover 350 is fixedly mounted on the mounting board 305 to cover the components mounted on the mounting board 305.

The control means further comprises auxiliary motor switching means 400 for starting the auxiliary motor 2; clutch motor switching means 500 for starting the clutch motor 1; needle position setting means 600 for setting the needle at a desired positions and a thread cutter starting means 700; and a control circuit 800.

In the preferred embodiment, the auxiliary motor switch means 400 includes an auxiliary motor starting switch 401. The auxiliary motor starting switch 401 is so arranged that its movable contact piece (or armature) 401*a* is tripped by the movement of the first operating lever 301 so that the switch is turned on and off. The auxiliary motor starting switch 401 is secured to the mounting board 305.

The clutch motor switching means 500 comprises a synchronizer 501 which is mounted on the spindle of the sewing machine in such a manner that it is adjacent to the driven pulley 43. The synchronizer 501 is able to detect the speed and needle position of the sewing machine.

The needle position setting means 600, as-shown in FIGS. 2 through 4, has a neutral actuator 601, and a first needle position switch 602. The thread cutter starting means 700 has a second needle position switch 603, and a safety actuator 604. The neutral actuator 601, the first and second needle position switches 602 and 603, and the safety actuator 604 are mounted on the side of the mounting board 305, which is opposite to the side where the transmission means 200 is provided.

The neutral actuator 601 has a drive shaft 601*a*, which is coupled to one end portion of a neutral lever 605. The other end portion of the neutral lever 605 is extended through a hole 606 formed in the mounting board 305 in such a manner that it is confronted with the upper edge of the second operating lever 303. The neutral lever 605 is rotatably supported on the mounting board 305 through a shaft 608. When the neutral actuator is started, that is, when its drive shaft 601*a* is positioned as shown in FIG. 4, is pulled (contracted), the other end portion of the neutral lever is turned so as to push the second operating lever 303 downwardly. In FIG. 4, reference numeral 609 designates a return spring mounted on the shaft 608 of the neutral lever 605. The end portion of the movable contact piece (armature) 602*a*of the first needle position switch 602 is set with the upper edge of the first operating lever 301 as shown in FIG. 3.

The safety actuator 604 has a drive shaft 604*a*. A safety pin 610 is secured to the drive shaft 604*a* at the end and extended in a direction substantially perpendicular to the longitudinal direction of the drive shaft 604*a*. One end portion of the safety pin 610 is extended through an elongated hole 611 formed in the mounting board 305, and when necessary, it moves under a protrusion 612 extending from the middle portion of the first operating lever 301. Therefore, when the drive shaft 604*a* of the safety actuator 604, positioned as shown in FIG. 4, is contracted, the safety pin 610 is caused to move under the protrusion 612 of the first operating lever 301 so as to limit the downward swing of the first operating lever 301.

In FIG. 4, reference numeral 613 designates a return spring mounted on the drive shaft 604*a* of the safety actuator 604. The thread cutter starting means 700 comprises a thread cutting solenoid 700*a*, and a thread cutting click 701. The thread cutting solenoid 700*a* operates the thread cutter. The thread cutting click 701, as shown in FIG. 4, includes a substantially U-shaped lever 703 which is rotatably mounted on the mounting board 305 through a shaft 702. One end portion of the lever 703 is a first arm 705 which extends through a hole 704 formed in the mounting board 305. The end portion of the first arm 705 is set with the upper edge of the first operating lever 301. The lever 703 further comprises a second arm 706 which is set with the movable contact 707 of the second needle position switch 603.

Figure 8:
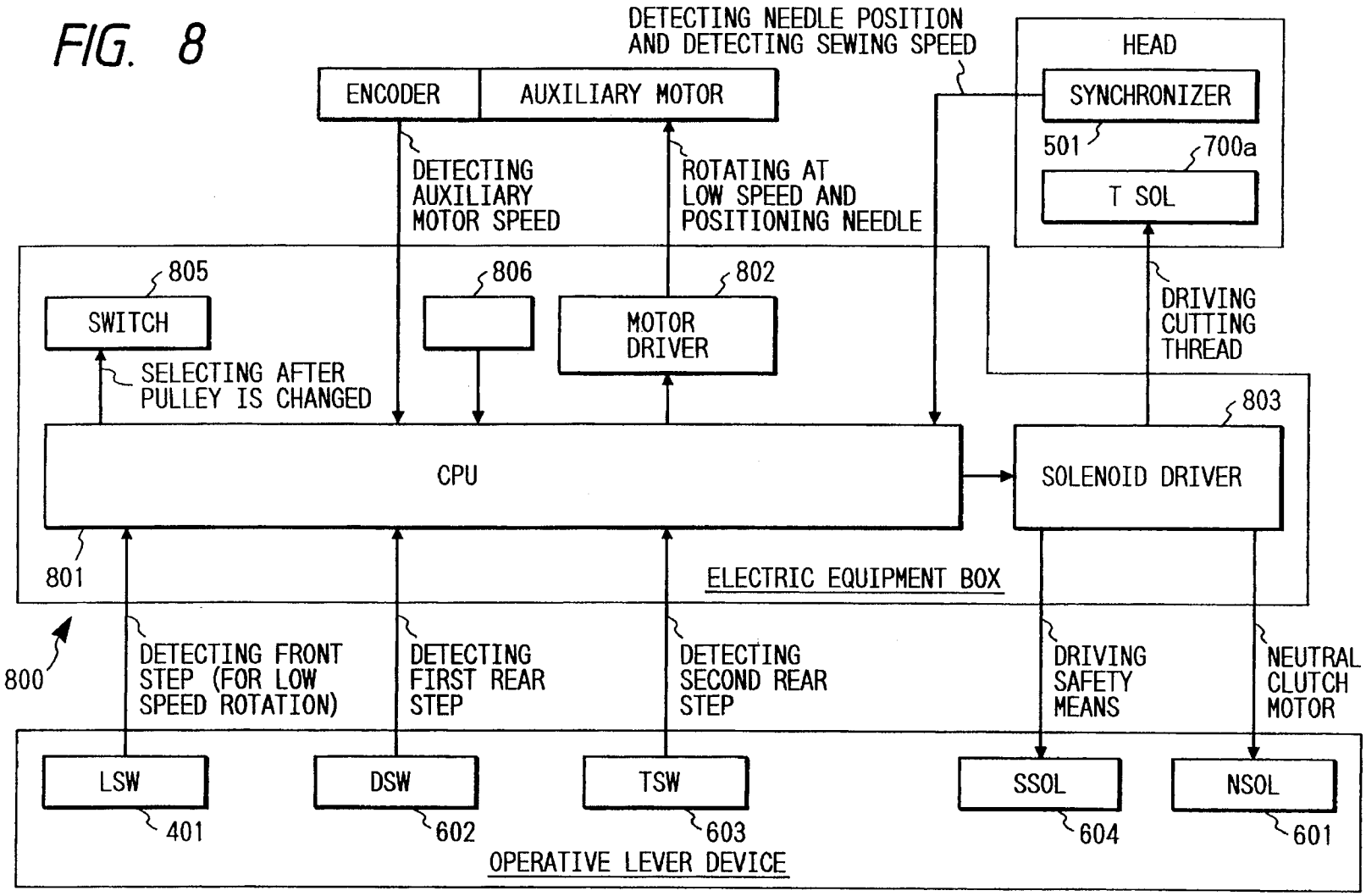
FIG. 8 is a block diagram showing the connection of the control means.

FIG. 8 is a block diagram showing the arrangement of the control circuit 800. The control circuit includes a CPU (central processing unit) 801, a motor driver 802 connected to the CPU 801, and a solenoid driver 803 connected to the CPU 801. The motor driver 802 is to control the auxiliary motor 2, and the solenoid driver 803 is to control the thread cutting solenoid. The CPU 801 is connected to the auxiliary motor starting switch 401, the first and second needle position switches 602 and 603, and other switches as shown in FIG. 8.

Rotation varying means 805 varies the rotation of the auxiliary motor. In a sewing machine with a clutch motor, in order to change the rotation of the spindle on the sewing machine, the pulley of the clutch motor is changed in diameter. In a sewing machine which uses the auxiliary motor to drive the drive shaft of the clutch motor, the rotation of the spindle of the sewing machine driven by the auxiliary motor is changed. Hence, the object of using the rotation varying means is to electrically control the rotation of the auxiliary motor according to the variation in diameter of the pulley of the clutch motor. In a preferred embodiment, the rotation varying means comprises a dip switch 806 as shown in FIG. 8; however, control may be performed according to the program of the CPU 801.

The operation of the sewing machine drive device thus constructed will be described in conjunction with the operations of the sewing machine performed in response to pedal operations.

When, as shown in FIGS. 2 and 5, the pedal is set at the first front step position, the front portion of the pedal at the neutral position is slightly depressed, and the transmission means 200 is operated. As was described above, the first operating lever 301 is swung downwardly through the first coupling rod 30, so that the horizontal portion 102 of the clutch lever 100 is moved downwardly, in the direction of the solid-line arrow in FIG. 5, with the aid of the coupling lever 302, the second operating lever 303, and the second coupling rod 304. As a result, the clutch board 32 is moved from the stop position shown in FIG. 5 to the neutral position. Hence, the spindle 4 of the sewing machine can be rotated by hand. In this connection, it should be noted that the auxiliary motor starting switch 401 is not turned on.

When the pedal is set at the second front step position, the front portion of the pedal is further depressed, and the auxiliary motor starting switch 401 is turned on, so that the auxiliary motor is driven to turn the spindle 4 of the sewing machine at a low speed.

Figure 9:
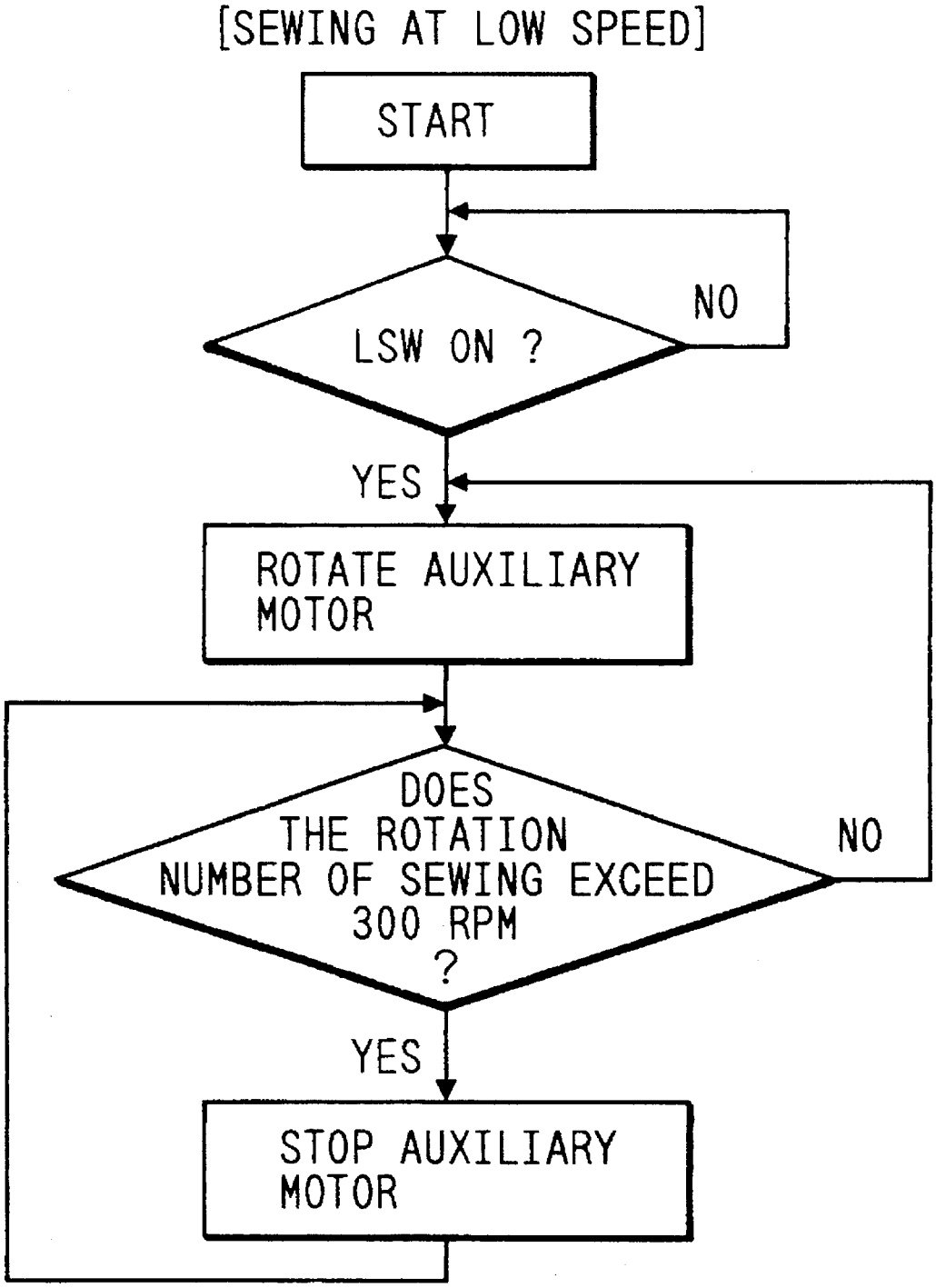
FIG. 9 is a flow chart for a description of a low-speed speed sewing operation with the sewing machine drive device of the invention.

FIG. 9 is a flow chart for a description of a low speed sewing operation.

When, after being set at the second front step position, the pedal is set at the third front step position, and the front portion of the pedal is further depressed, the transmission means 200 is operated in the same manner as it was operated in response to the first front step of the pedal. As a result, the clutch board 32 is moved to the drive position so that it is pushed against the rotor 30. The rotation of the clutch motor is transmitted through the clutch shaft 33, the drive pulley 40, the endless belt 44 and the driven pulley 43 to the spindle 4 of the sewing machine, so that the sewing machine is rotated at high speed. This high speed rotation is utilized for an ordinary sewing operation.

When the high speed exceeds a predetermined value, the synchronizer 501 detects it, to stop the rotation of the auxiliary motor. The auxiliary motor sets the speed of rotation of the spindle to a predetermined value or lower; for instance about 300 rpm or smaller—for instance about 170 rpm. This will reduce the power consumption of the auxiliary motor, and increase the machine service life.

When the rear portion of the pedal at the third front step position is depressed so that the pedal is set at the neutral position (or release position), the first coupling rod 30 is moved upwardly, and the first operating lever 301 is swung upwardly. In this operation, the upward swing of the first operating lever 301 is not immediately transmitted to the second operating lever 303. This is due to the slot 313 formed in the other end portion of the coupling lever 302. When the upward movement of the first operating lever 301 becomes larger than the length of the slot 313, the second operating lever 303 is moved upwardly. When the first operating lever is moved along the slot of the coupling lever, the tension spring is pulled.

When the second operating lever 303 is moved upwardly, the second coupling rod 304 is moved upwardly, so that the horizontal portion 102 of the clutch lever 100 is moved upwardly as viewed in FIG. 5, in the direction of the broken-line arrow, and the clutch board 32 is moved to the right by the elastic force of the clutch lever return spring 108, and is pushed against the brake shoe 31 (at the stop position of the clutch motor). As a result, the clutch motor 1 is stopped. Under this condition, the sewing needle is at an unstable stop position.

when the pedal is set at the first rear step position; that is, when the rear portion of the pedal at the neutral position is depressed by foot, the first coupling rod 300 is moved upwardly, and the first operating lever 301 is swung upwardly. As a result, the upper edge of the first operating lever 301 is brought into contact with the movable contact piece 602*a* of the first needle position switch 602 to turn on the first needle position switch 602. At the same time, the synchronizer 501 detects the needle position, and starts the neutral actuator 601 if the needle is at the needle up position. When the drive shaft 601*a* of the neutral actuator 601 is contracted, the neutral lever 605 is operated, so that the second operating lever 303 is swung downwardly. In this operation, the downward swing of the second operating lever 303 is not transmitted to the first operating lever 301 because the first operating lever 301 is moved along the slot 313 formed in the coupling lever 302. The downward swing of the second operating lever 303 moves the second coupling rod 304 downwardly, so that the horizontal portion 102 of the clutch lever 100 is moved downwardly, whereby the clutch board 31 positioned as shown in FIG. 5 is moved to the left to cause the clutch motor to take the neutral position.

When the clutch motor takes the neutral position in the above-described manner, the auxiliary motor 2 rotates the sewing machine spindle 4 at a low speed. Next, the synchronizer 501 detects the needle position, and outputs a needle down position signal when the needle is at the needle down position. The lower needle position signal deactivates (turns off) the neutral actuator 601 and the auxiliary motor 2. As a result, the neutral lever 605 is returned to the original position by the return spring 609 to release the second operating lever 303, whereby the second operating lever 303 is swung upwardly by the tension spring 315. As the second operating lever 303 is swung in this manner, the second coupling rod 304 is moved upwardly to raise the horizontal portion 102 of the clutch lever 100, so that the clutch board 32 is moved to the right as viewed in FIG. 5, that is, it is pushed against the brake shoe 31. As was described above, the elastic forces of the clutch lever return spring 108 and the tension spring 315 are utilized to push the clutch board 31 against the brake shoe 31 to stop the auxiliary motor. The elastic forces of the clutch lever return spring 108 and the tension spring 315 are effective in bringing the clutch board into contact with the brake shoe. Thus, the clutch shaft 33 is fixed, and the sewing machine spindle 4 and the auxiliary motor 2 are stopped.

When the pedal is at the first rear step position, the auxiliary motor rotates the sewing machine spindle at a low speed, and stops rotation when the sewing needle is at the needle down position. The needle can be stopped at the needle down position. In addition, the needle can be stopped at the needle up position in the same manner with the aid of an needle up and down position selecting switch 806.

When, the end of the pedal at the second rear step position (corresponding to the high speed rotation of the sewing machine) is repeatedly depressed, the pedal is set at the second rear step position, the first operating lever 301 is swung upwardly through the first coupling rod 300, so that the first needle position switch 602 is turned on, and the first arm 705 of the thread cutting click 701 is raised while the second arm 706 of the thread cutting click 701 is moved downwardly, to depress the movable contact of the second needle position switch 603, and to turn on the second needle position switch 603.

In this connection, the control circuit 800 stares the safety actuator 604, and the drive shaft 604*a* of the safety actuator 604 is contracted against the elastic force of the return spring 613, so that the safety pin 610 is caused to come under the protrusion 612 of the first operating lever 301 to prevent the downward swing of the first operating lever 301. This prevents the first operating lever from being moved downwardly by carelessly depressing the front portion of the pedal, and the return of the pedal allows the tension spring 315 to have a certain acting force, which can be utilized to push the clutch board against the brake shoe in the above-described manner.

When the safety actuator 604 is started, the synchronizer 501 outputs the needle down position signal. In response to the needle down position signal, the neutral actuator 601 is started. The drive shaft 601*a* is contracted, so that the neutral lever 605 is driven to cause its end portion to downwardly swing the second operating lever 303. In this operation, the downward swing of the second operating lever 303 is not transmitted to the first operating lever 301 because the first operating lever 301 is moved along the slot 313 formed in the coupling lever 302. The downward swing of the second operating lever 303 moves the second coupling rod 304 downwardly, and accordingly, the horizontal portion 102 of the clutch lever 100 is moved downwardly. As a result, the clutch board 32 positioned as shown in FIG. 5 is moved to the left, so that the clutch motor 1 takes the neutral position.

Figure 10:
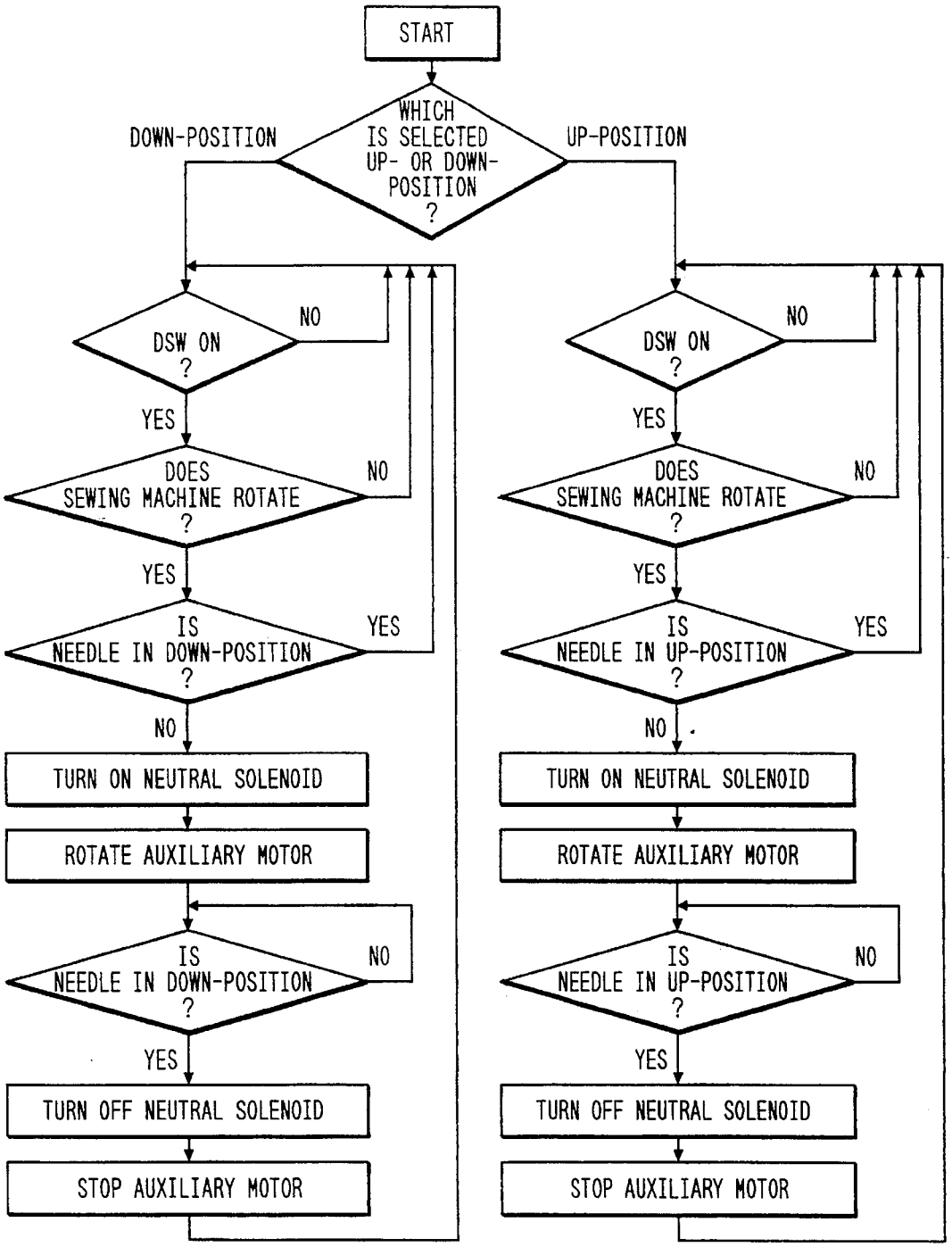
FIG. 10 is a flow chart for a description of the operation of stopping the needle at a needle up position or at a needle down position.
Figure 11:
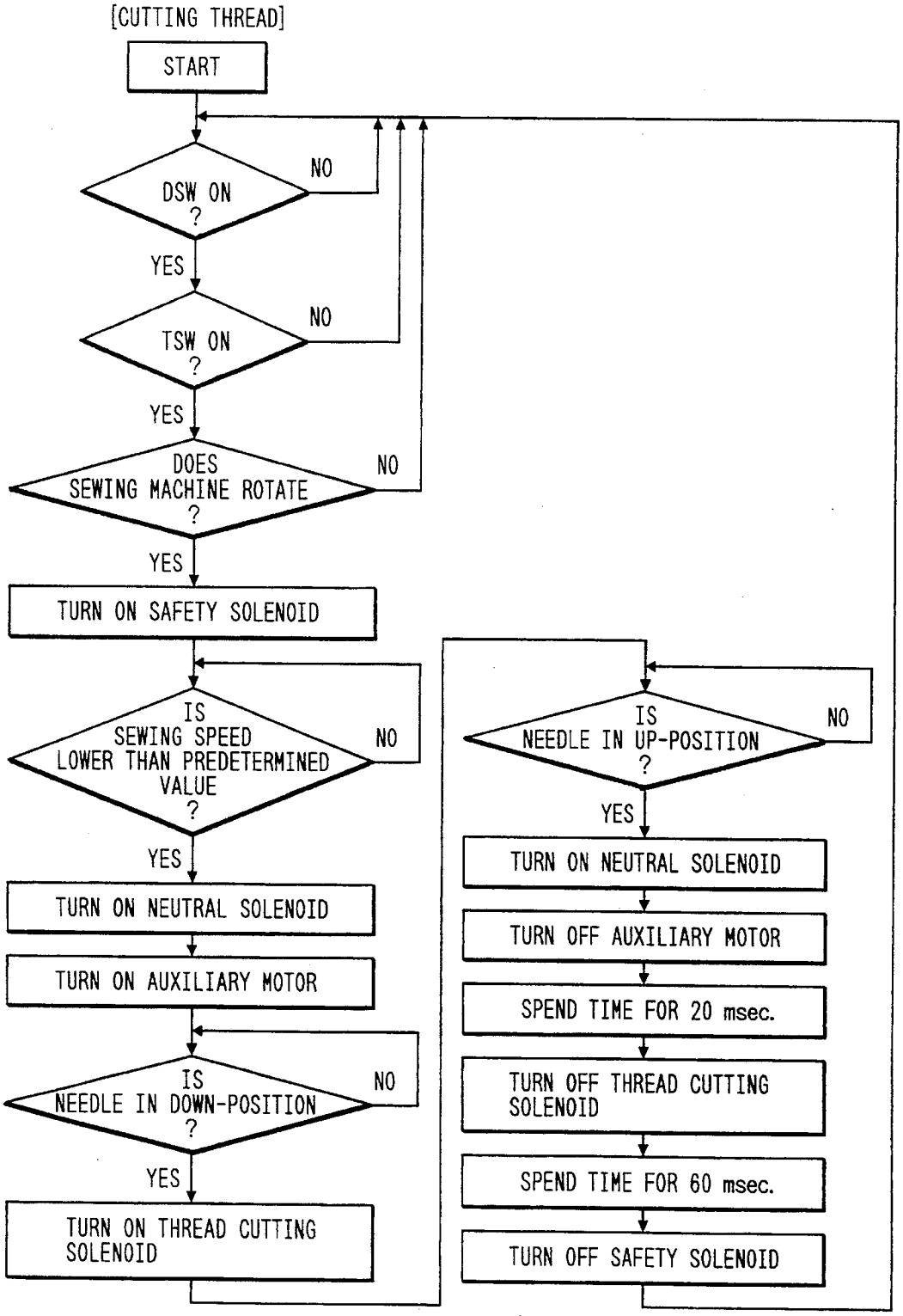
FIG. 11 is a flow chart for a description of a thread cutting operation with the sewing machine drive device of the invention.

When the clutch motor 1 takes the neutral position, the auxiliary motor 2 rotates the sewing machine spindle 4 at a low speed. Next, the synchronizer 501 detects the needle position, and outputs the needle down position signal when the needle comes to the needle doll position. In response to the needle down position signal, the control circuit starts the thread cutting solenoid, to cut the thread with the thread cutter. The thread cutting operation can be carried out when the sewing machine is driven at a low speed. After the thread cutting operation, the synchronizer 501 detects that the needle is at the needle up position, and outputs the needle up position signal. In response to the needle up position signal, the control circuit operates to stop the sewing machine spindle 4 with the needle at the needle up position, deenergizes the thread cutting solenoid in, for instance, 20 msec (timer), and deactivates the safety actuator 604 in, for instance, 60 msec (timer). FIG. 10 is a flow chart for a description of the operation of stopping the needle at the needle up position and at the needle up position. FIG. 11 is a flow chart for a description of the thread cutting operation.

In response to the needle up position signal, the neutral actuator 601 and the auxiliary motor 2 are deactivated. The drive shaft 601*a* of the neutral actuator 601 is pushed out by the elastic force of the return spring 609. As a result, the neutral lever 605 is swung so that the other end portion is moved away from the second operating lever 303. Accordingly, the second operating lever 303 is swung upwardly by the elastic force of the tension spring 315, whereby the horizontal portion 102 of the clutch lever 100 is raised through the second coupling rod 304. As was described before, the clutch board 31 is moved to the right in FIG. 5 so that it is pushed against the brake shoe 31. The elastic forces of the clutch lever return spring 108 and the tension spring 315 contribute t:o the contact of the clutch board with the brake shoe. As a result, the auxiliary motor is stopped, and the needle is stopped at the needle up position. Thereafter, the pedal is operated to take the neutral position, so that the first operating lever 301 is swung downwardly, and the thread cutting click 701 is returned to the original position.

Figure 12:
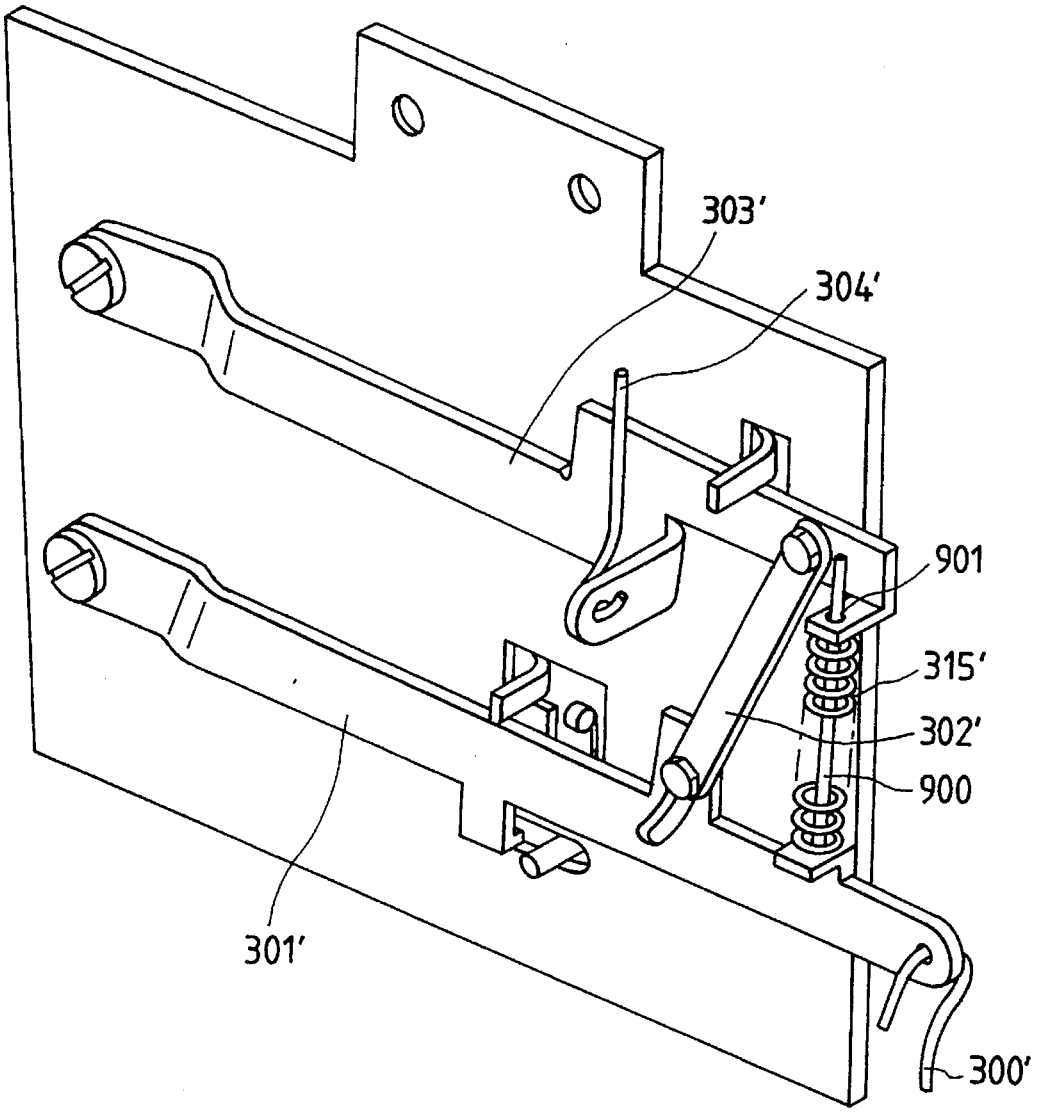
FIG. 12 is a perspective view showing a second embodiment of the invention, corresponding to FIG. 3.
Figure 13:
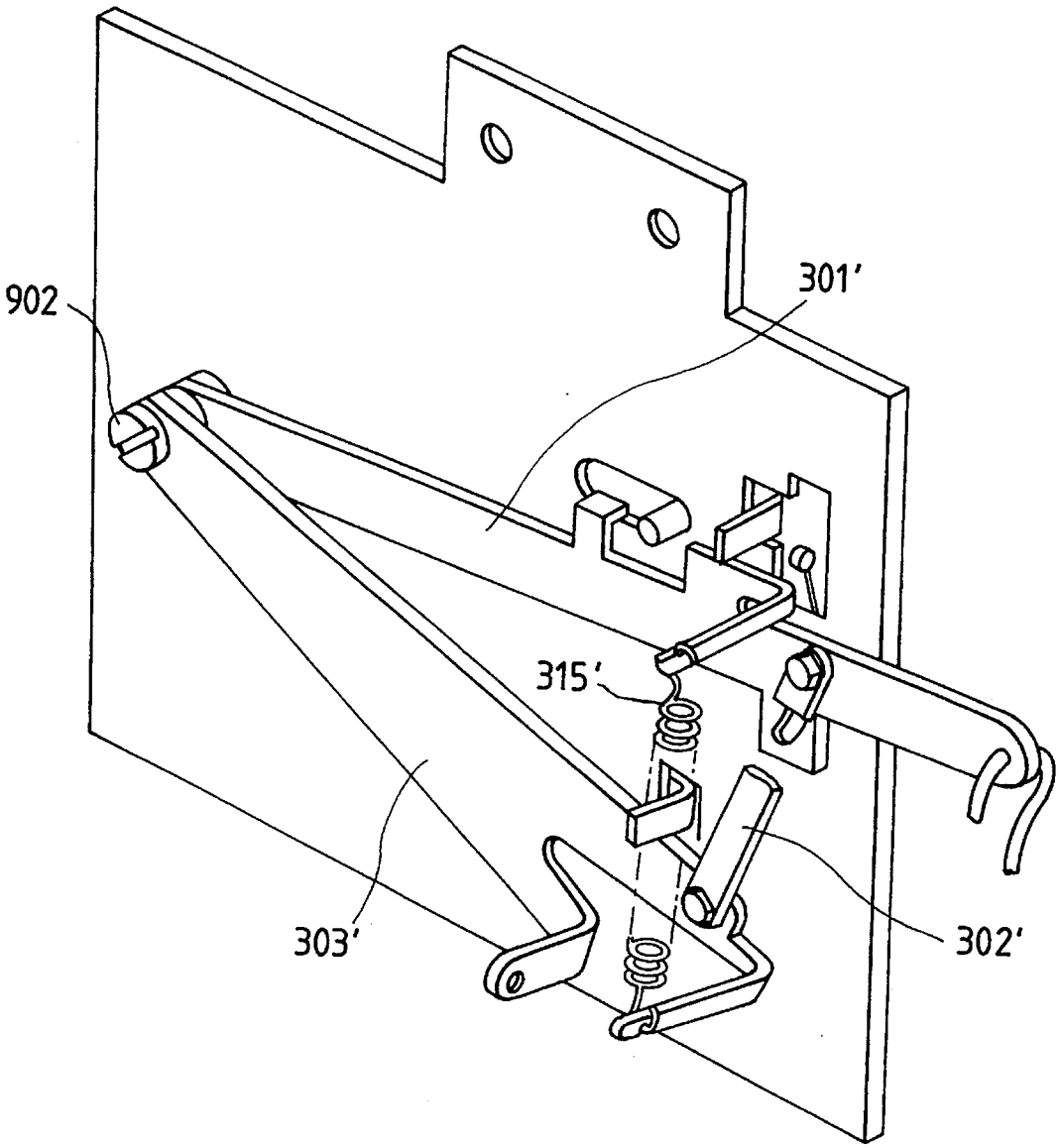
FIG. 13 is a perspective view showing a third embodiment of the invention, corresponding to FIG. 3.
Figure 14:
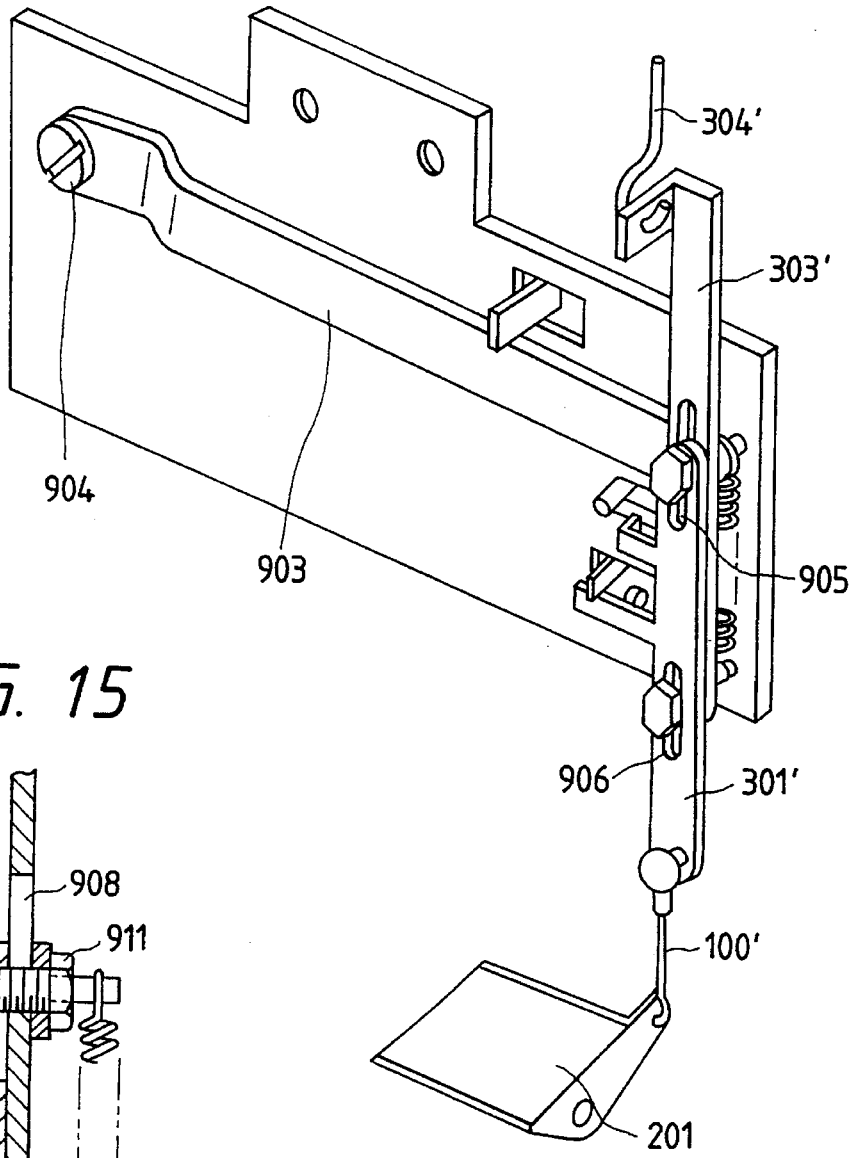
FIG. 14 is a perspective view showing a fourth embodiment of the invention, corresponding to FIG. 3.
Figure 15:
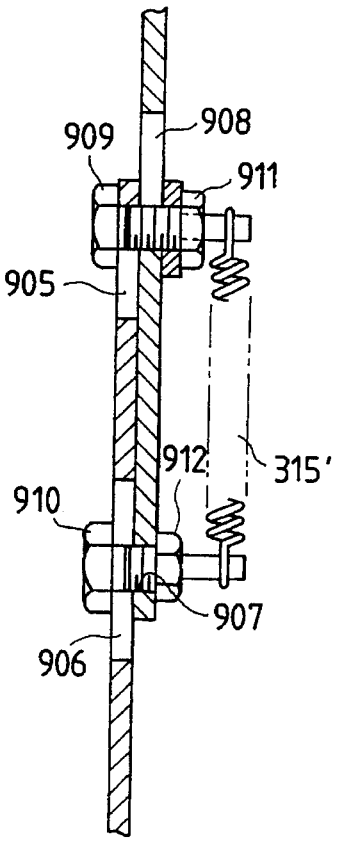
FIG. 15 is a sectional view showing the connection of first and second operating levers in the fourth embodiment shown in FIG. 14.

FIG. 12 shows a second embodiment of the invention. FIG. 13 shows a third embodiment of the invention. FIGS. 14 and 15 show a fourth embodiment of the invention. In FIGS. 12 through 15, parts corresponding functionally to those which have been described with reference to the first embodiment of the invention are therefore designated by the same reference numerals or characters primed (').

The second embodiment shogun in FIG. 12 is different from the first embodiment for the reasons that follow. The first operating lever 301 is located below the second operating lever 303'. The tension spring 315' is put on a rod 900. The lower end portion of the rod 900 is fixedly secured to the upper edge of the first operating lever 301', and the upper end portion is loosely fitted in a hole 901 formed in an ear which is extended from the lower edge of the second operating lever 303'.

The third embodiment shown in FIG. 13 is different from the first embodiment for the reasons that follow. The first operating lever 301' and the second operating lever 303' are rotatably mounted on one and the same supporting shaft 902.

The fourth embodiment shown in FIGS. 14 and 15 is different from the first embodiment for the reasons that follow. The first operating lever 301' is laid on the second operating lever 303' in such a manner that those levers are extended vertically. Both the first and second operating levers 301' and 303' are supported on one end of a supporting lever 903 which is laid horizontal.

The other end of the supporting lever 903 is rotatably mounted on the mounting board 305 through a shaft 904.

An upper slot 905 and a lower slot 906 are formed in both end portions of the first operating lever 301'.

A hole 907 is formed in the lower end portion of the second operating lever 303' in such a manner that it is adjacent to the lower slot 906 of the first operating lever 301'. In addition, a slot 908 is formed in the second operating lever 303' in such a manner that it is located above the hole 907 and is adjacent to the upper slot 905 of the first operating lever 301'. A first bolt 909 is inserted into the upper slot 905 of the first operating lever 301' and the slot 908 of the second operating lever 303'. A second bolt 910 is inserted into the lower slot 906 of the first operating lever 301' and the hole 907 of the second operating lever 303'.

The first and second nuts 909 and 910 thus inserted are opposite nuts 911 and 912, respectively, to hold the first and second operating levers in such a manner that they are slidably laid on each other.

The first and second bolts 909 and 910 are coupled through the tension spring 315.

The second, third and fourth embodiments operate in the same manner as the first embodiment.

In the above-described embodiments, the torque of the clutch motor is transmitted through the pulley assembly to the spindle of the sewing machine, and the torque of the auxiliary motor is transmitted through the sprocket assembly to the spindle of the sewing machine. However, the invention is not limited in this respect. For instance, the pulley assembly and the sprocket assembly may be replaced with other means such as for instance gear assemblies.

In the sewing machine drive device according to the invention, the rotation varying means is provided for the auxiliary motor, so that the speed (rpm) of the auxiliary motor can be varied proportional to the variations in diameter of the pulley of the clutch motor. Hence, the speed of the sewing machine spindle can be set to a value suitable for a given sewing operation.

The force of the elastic member adds pressure for returning the clutch lever to the stop position. The present invention promptly and completely sets the clutch motor in the stop position.

The foregoing description of the preferred embodiments of the invention has been presented for purposes of illustration and description. It is not intended to be exhaustive or to limit the invention to the precise form disclosed, and modifications and acquired from practice of the invention. The embodiments were chosen and described in order to explain the principles of the art to utilize the invention in various embodiments and with various modifications as are suited to the particular use contemplated. It is intended that the scope of the invention be defined by the claims appended hereto, and their equivalents.

What is claimed is:

1. A drive device for use with a sewing machine having an auxiliary motor, said drive device comprising:

a clutch motor drive shaft for rotating a sewing machine shaft at a first speed;

an auxiliary motor drive shaft, operatively coupled to said clutch motor drive shaft, for rotating said sewing machine shaft at a second speed less than said first speed;

means for detecting rotational speed of the sewing machine shaft;

means for stopping rotation of said auxiliary motor drive shaft when the rotational speed detected by the detecting means exceeds a predetermined speed greater than said second speed; and rotation varying means for varying rotation speed of said auxiliary motor drive shaft.

2. A drive device as claimed in claim 1, in which said rotation varying means comprises a dip switch connected to said auxiliary motor.

3. A drive device as claimed in claim 1, in which said rotation varying means comprises a central processing unit (CPU) connected to said auxiliary motor.

4. A drive device for use with a sewing machine, said drive device comprising:

a clutch motor including a clutch lever having a driving position, a neutral position, and a stop position, said clutch motor rotating a sewing machine shaft at a first speed;

an auxiliary motor for rotating the sewing machine shaft at a second speed less than said first speed; and control means for selectively transmitting rotational motion from one of said clutch motor and said auxiliary motor to the sewing machine shaft, said control means including an actuator having a neutral step position, plural front step positions, and plural rear step positions, and transmitting means for transmitting a position of said actuator to said clutch lever, said transmitting means having a first operating lever coupled to said actuator, a second operating lever coupled to said clutch lever and an elastic member coupling said second operating lever with said first operating lever, said elastic member urging said first operating member to move said clutch lever toward said stop position when said actuator moves from one of said front step positions to one of said rear step positions.

5. A drive device for use with a sewing machine, said drive device comprising:

a clutch motor for rotating a sewing machine shaft at a first speed when a clutch board rotationally coupled to the sewing machine shaft contacts a rotor via a clutch lever, and for stopping the sewing machine shaft when said clutch board presses against a brake shoe;

an auxiliary motor, coupled to a driving portion rotated by said clutch motor through a one way clutch, for rotating the sewing machine shaft at a second speed less than the first speed;

a foot pedal coupled to said clutch lever, said foot pedal having a front step position, a first rear step position, and a second rear step position;

a first operating lever coupled to said foot pedal;

a second operating lever coupled to said clutch lever;

a mechanism connecting said first operating lever and said second operating lever, said mechanism transmitting rotation of said first operating lever to said second operating lever and limiting transmission of rotation of said second operating lever to said first operating lever;

an elastic member provided between said first operating lever and said second operating lever, said elastic member transmitting movement from said foot pedal when said foot pedal moves from said front step position to one of said first rear step position and said second rear step position;

a neutral actuator for operating said second operating lever to place said clutch board in a neutral position;

a first needle position switch for generating a stop-at-down-position signal in response to said foot pedal moving to said first rear step position;

a second needle position switch for generating a stop-at-up-position signal in response to said foot pedal moving to said second rear step position;

a synchronizer for generating a needle up-position signal and a needle down-position signal in response to rotation of the sewing machine shaft; and a control circuit for activating said neutral actuator and said auxiliary motor in response to said stop-at-down-position signal from said first needle position switch, for stopping said auxiliary motor in response to said needle down-position signal from said synchronizer, for activating said auxiliary motor in response to said stop-at-up-position signal from said second needle position switch, and for deactivating said neutral actuator and said auxiliary motor in response to said needle up-position signal from said synchronizer.

* * * * *